US010037004B2

(12) United States Patent
Hori

(10) Patent No.: US 10,037,004 B2
(45) Date of Patent: Jul. 31, 2018

(54) IMAGE FORMING APPARATUS HAVING DUCT FOR COOLING FIXING SECTION

(71) Applicant: KYOCERA Document Solutions Inc., Osaka (JP)

(72) Inventor: Toshio Hori, Osaka (JP)

(73) Assignee: KYOCERA Document Solutions Inc., Tamatsukuri, Chuo-ku, Osaka (JP)

( * ) Notice: Subject to any disclaimer, the term of this patent is extended or adjusted under 35 U.S.C. 154(b) by 0 days.

(21) Appl. No.: 15/689,149

(22) Filed: Aug. 29, 2017

(65) Prior Publication Data

US 2018/0059617 A1 Mar. 1, 2018

(30) Foreign Application Priority Data

Aug. 31, 2016 (JP) ..... 2016-170131

(51) Int. Cl.
*G03G 21/00* (2006.01)
*G03G 21/20* (2006.01)
*B41J 29/377* (2006.01)

(52) U.S. Cl.
CPC ..... *G03G 21/206* (2013.01); *B41J 29/377* (2013.01); *G03G 2221/1645* (2013.01)

(58) Field of Classification Search
CPC ..... G03G 21/206; G03G 2221/1645; G06F 1/20; B41J 29/377; F28F 1/00; F28F 1/006; F24F 7/08; F24F 12/006; F24F 13/22; F24F 2013/227
USPC ..... 399/92; 312/236; 361/678, 679.49, 695, 361/696
See application file for complete search history.

(56) References Cited

U.S. PATENT DOCUMENTS 2,617,915 A * 11/1952 Gerhardt ..... H05B 3/342 137/625.46
4,727,385 A 2/1988 Nishikawa et al.
7,706,712 B2 * 4/2010 Shuto ..... G03G 15/2003 399/341
8,977,159 B2 * 3/2015 Takehara ..... G03G 21/206 399/92
9,063,482 B2 * 6/2015 Ikeda ..... G03G 21/206
(Continued)

FOREIGN PATENT DOCUMENTS

JP S62-153073 A 7/1987
JP H08-044274 A 2/1996
(Continued)

*Primary Examiner* — Robert Beatty
(74) *Attorney, Agent, or Firm* — IP Business Solutions, LLC

(57) ABSTRACT

An image forming apparatus includes: a fixing section; a housing having an air inflow hole, an air outflow hole, a duct, and a fan circulating the air in the duct; and a main body frame. The duct has: (i) a first duct part extending from the air inflow hole to an arrangement region; (ii) a second duct part continuing to the first duct part and extending along the arrangement region; (iii) a third duct part extending from the air outflow hole to the arrangement region; (iv) a fourth duct part continuing to the third duct part and extending along the arrangement region at a position different from the second duct; and (v) a fifth duct part being provided between the second and the fourth duct parts and being curved in a meandering manner in a region, other than the arrangement region, located between the housing and the main body frame.

11 Claims, 6 Drawing Sheets

(56) References Cited

U.S. PATENT DOCUMENTS

| | | | | |
|---|---|---|---|---|
| 2004/0070949 | A1* | 4/2004 | Oikawa | F28D 15/0266 361/718 |
| 2004/0114324 | A1* | 6/2004 | Kusaka | G06F 1/203 361/679.53 |
| 2007/0145041 | A1* | 6/2007 | Shim | H05B 6/108 219/635 |
| 2013/0077245 | A1* | 3/2013 | Gradinger | F28D 1/035 361/700 |
| 2014/0340846 | A1* | 11/2014 | Kurita | H05K 7/20145 361/695 |

FOREIGN PATENT DOCUMENTS

| | | | | | |
|---|---|---|---|---|---|
| JP | 10252404 | A | * | 9/1998 | F01D 5/187 |
| JP | 11038808 | A | * | 2/1999 | |
| JP | 2005141225 | A | * | 6/2005 | G03G 15/11 |
| JP | 2005-268584 | A | | 9/2005 | |
| JP | 2010237451 | A | * | 10/2010 | |
| JP | 2012073335 | A | * | 4/2012 | |
| JP | 2013054206 | A | * | 3/2013 | |

* cited by examiner

IMAGE FORMING APPARATUS HAVING DUCT FOR COOLING FIXING SECTION

INCORPORATION BY REFERENCE

This application claims priority to Japanese Patent Application No. 2016-170131 filed on 31 Aug. 2016, the entire contents of which are incorporated by reference herein.

BACKGROUND

This disclosure relates to an image forming apparatus and a duct used for the same, and more specifically to a technology of cooling the air headed by a fixing section which fixes an image on recording paper.

In image forming apparatuses, recording paper on which an image is formed is typically heated by a fixing section to thereby fix the image onto the recording paper. In a process of this fixation, not only the recording paper but also the air therearound is also heated. As a result, a temperature difference arises between the air around the recording paper and members such as a recording paper guide provided above the fixing section, leading to a risk of occurrence of dew condensation in which waterdrops adhere to these members.

In typical image forming apparatuses, for example, a fan for discharging the air heated by a fixing section is provided, thereby making it difficult to cause the aforementioned dew condensation.

SUMMARY

As one aspect of this disclosure, a technology obtained by further improving the aforementioned technology will be suggested.

An image forming apparatus according to one aspect of this disclosure includes: an image formation section, a fixing section, a housing, and a main body frame. The image formation section forms an image on recording paper. The fixing section fixes the image onto the recording paper by heating the recording paper on which the image is formed. The housing forms an outline of the image forming apparatus. The main body frame stores the image formation section and the fixing section. The housing is provided with: an air inflow hole; an air outflow hole, a duct connecting together the air inflow hole and the air outflow hole; and a fan circulating the air in the duct. The duct has: (i) a first duct part extending from the air inflow hole to an arrangement region where the fixing section is arranged; (ii) a second duct part continuing to the first duct part and extending along the arrangement region; (iii) a third duct part extending from the air outflow hole to the arrangement region; (iv) a fourth duct part continuing to the third duct part and extending along the arrangement region at a position different from a position along which the second duct part extends; and (v) a fifth duct part being provided between the second duct part and the fourth duct part and being curved in a meandering manner in a region, other than the arrangement region, located between the housing and the main body frame.

A duct according to another aspect of this disclosure is used in an image forming apparatus including an image formation section, a fixing section, a housing forming an outline, and a main body frame storing the image formation section and the fixing section, and has: a first duct part extending from an air inflow hole provided in the housing to an arrangement region where the fixing section is arranged; a second duct part continuing to the first duct part and extending along the arrangement region; a third duct part extending from an air outflow hole provided in the housing to the arrangement region; a fourth duct part continuing to the third duct part and extending along the arrangement region at a position different from a position along which the second duct part extends; and a fifth duct part being provided between the second duct part and the fourth duct part and being curved in a meandering manner in a region, other than the arrangement region, located between the housing and the main body frame.

DETAILED DESCRIPTION

Figure 1:
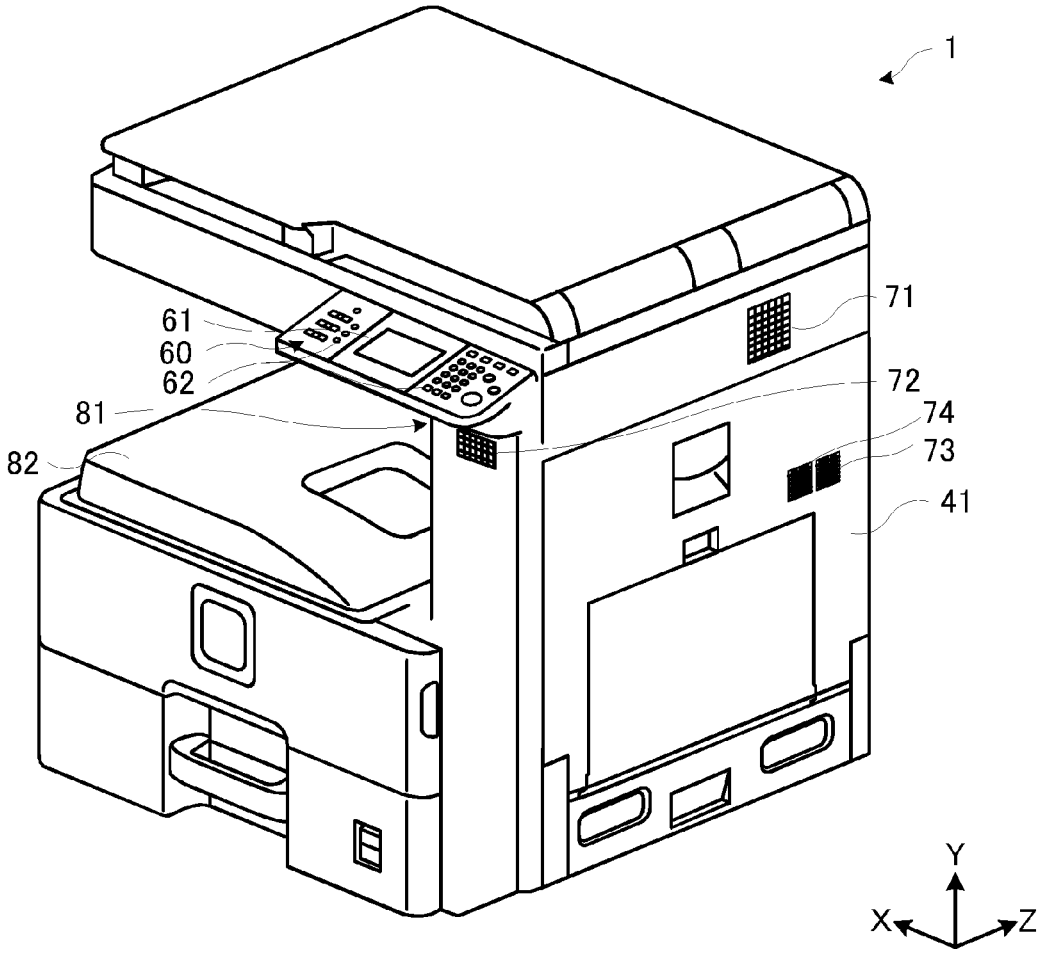
FIG. 1 is a perspective view illustrating outer appearance of an image forming apparatus according to one embodiment of this disclosure.
Figure 2:
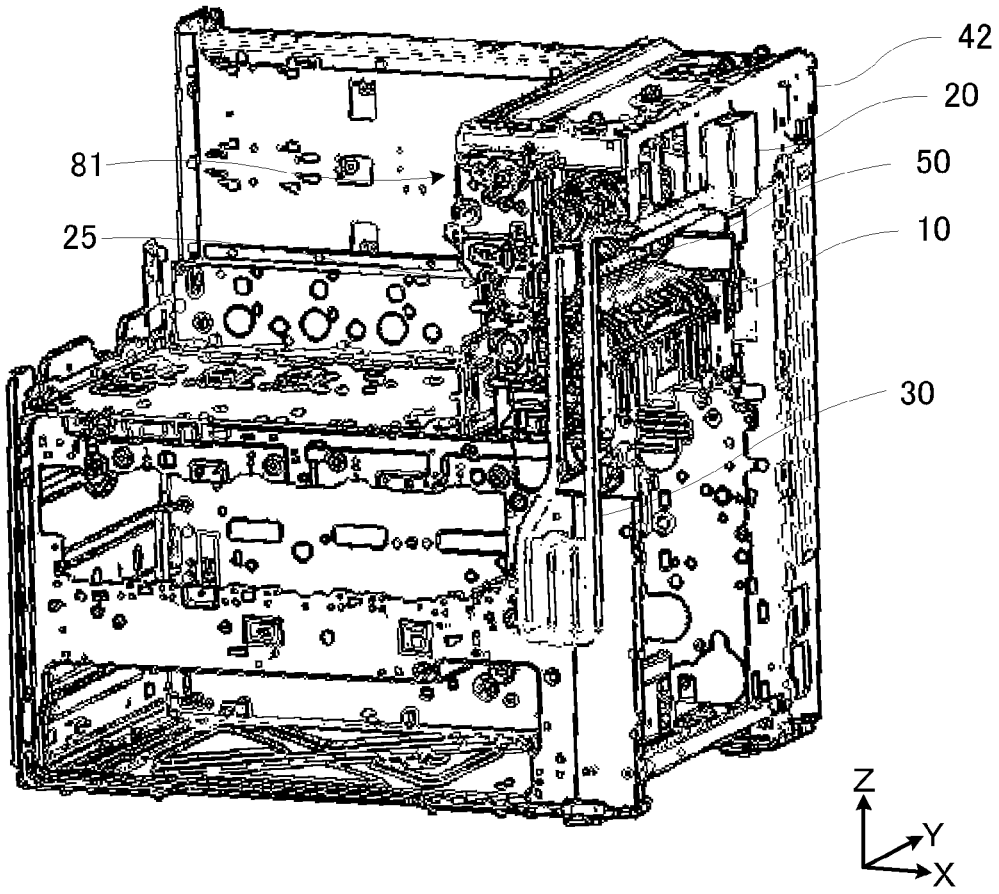
FIG. 2 is a perspective view illustrating an inner configuration of the image forming apparatus according to one embodiment of this disclosure.

Hereinafter, an image forming apparatus and a duct according to one embodiment of this disclosure will be described with reference to the drawings. FIG. 1 is a perspective view illustrating outer appearance of the image forming apparatus according to one embodiment of this disclosure. FIG. 2 is a perspective view illustrating an inner configuration of the image forming apparatus according to one embodiment of this disclosure.

An image forming apparatus 1 is an apparatus which forms an image on recording paper through an electrophotographic method, and has an outline formed by a housing 41 of a resinous material. Arranged on a front surface of the housing 41 is an operation section 60 composed of a display section 61 and physical keys 62. Provided inside the housing 41 is a main body frame 42 made of metal, which stores members, such as a paper feed section (not illustrated), an image formation section (not illustrated), and a fixing section 10 required for image formation. Note that configurations of the paper feed section, the image formation section, etc. are not illustrated for better drawing visualization in FIG. 2.

The paper feed section includes: a paper feed cassette which stores recording paper; a sending roller which sends the paper stored in the paper feed cassette towards the image formation section; etc.

The image forming section includes a photoconductive drum, a charging device, an exposure device, a developing device, etc., and forms a toner image on the photoconductive drum through charging, exposure, and developing processes. The toner image formed on the photoconductive drum is transferred onto the recording paper conveyed from the paper feed section.

The fixing section 10 includes a heat roller and a pressure roller. The heat roller has a heat source, such as a halogen lamp or a xenon lamp, provided therein. The pressure roller has a circumferential surface formed of an elastic layer of silicon rubber. The heat roller and the pressure roller are arranged oppositely to each other. Through thermal compression by a nip part formed between the heat roller and the pressure roller, the toner image is fixed onto the recording paper.

The recording paper subjected to the fixation is guided by a recording paper guide 50 which is provided above the fixing section 10 (in plus Z-axis direction) to be conveyed towards a discharge port 81. The recording paper discharged from the discharge port 81 is stacked on a discharge tray 82.

A plurality of louvers 71, 72, 73, and 74 are formed in the housing 41. The louvres are used for introducing the air outside of the apparatus and discharging the air inside of the apparatus towards the outside of the apparatus. Out of the aforementioned louvers, the louver 71 and the louver 72 are connected together by a duct 30.

A fan 20 is installed at an end part of the duct 30 located on a side close to the louver 71. The fan 20 is composed of a plurality of blades (not illustrated) and a motor (not illustrated) which rotates the blades, and generates an airflow directed in a X-plus direction in the figure. Consequently, an airflow path is formed for the air to flow from the outside of the apparatus into the duct 30 through the louver 72, flow from an end part of the duct 30 on a side close to the louver 72 to the end part of the duct 30 on the side close to the louver 71, and be then discharged to the outside of the apparatus through the louver 71. That is, the louver 71 functions as an air discharge hole while the louver 72 functions as an air inflow hole. Moreover, as illustrated in FIG. 1, the louver (air inflow hole) 72 is provided on a front surface side of the image forming apparatus 1 in the housing 41.

Figure 3:
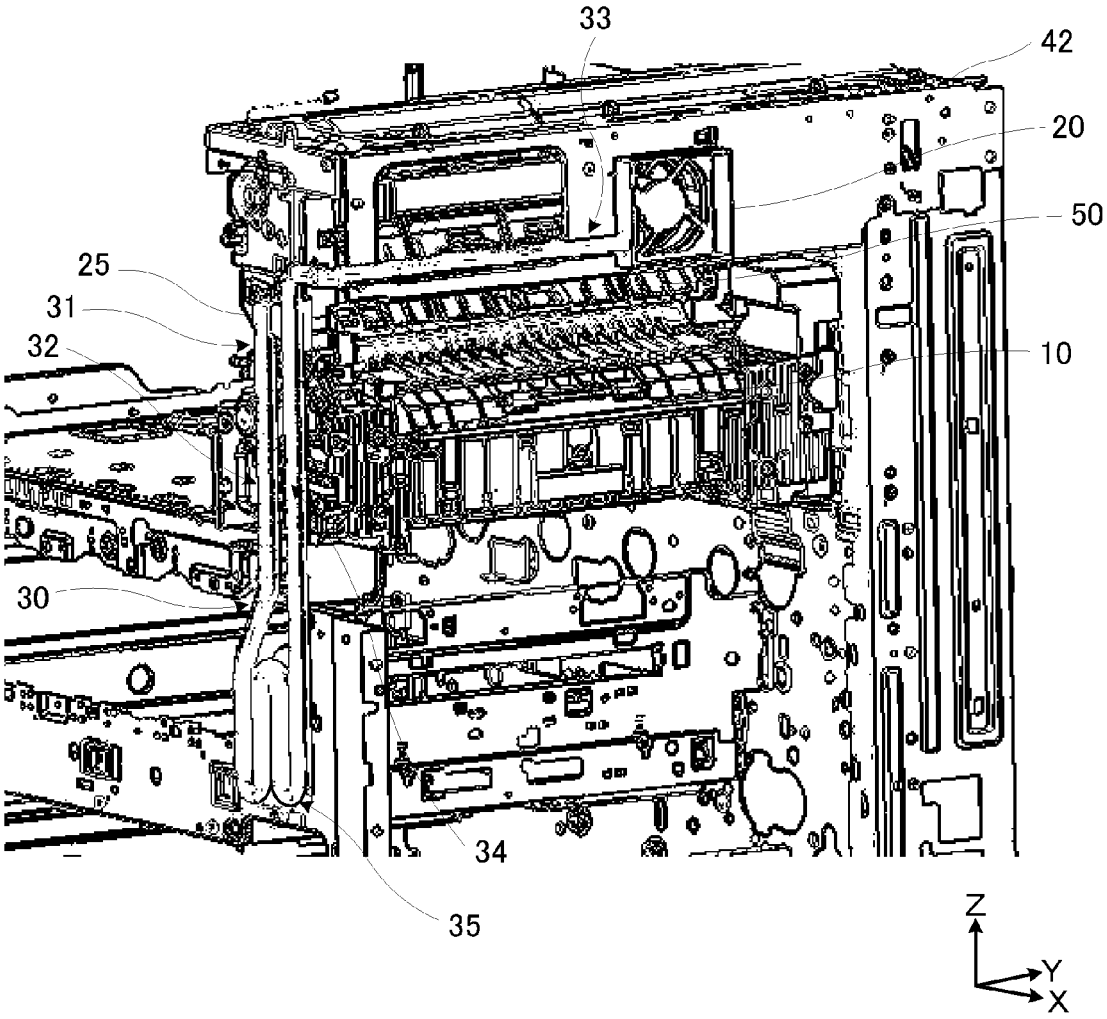
FIG. 3 is an enlarged view illustrating an inner configuration located near a duct of the image forming apparatus according to one embodiment of this disclosure.
Figure 4:
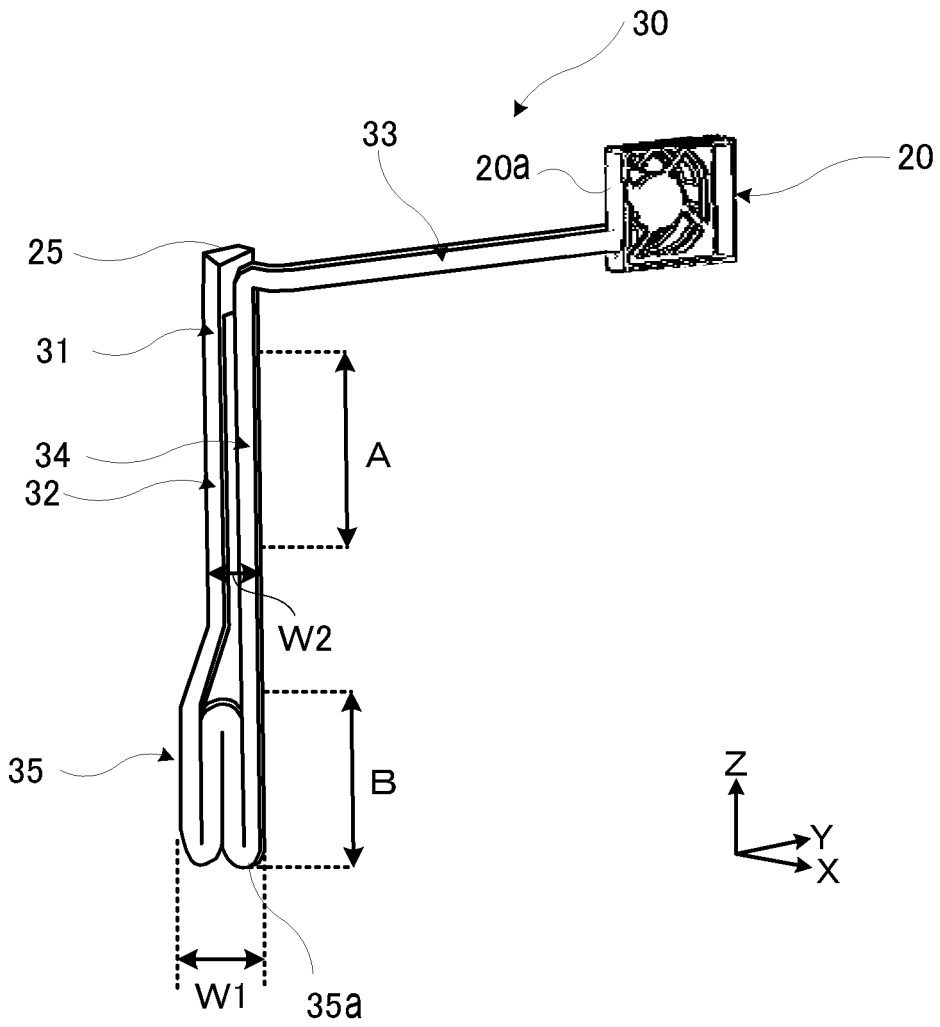
FIG. 4 is a perspective view illustrating the duct of the image forming apparatus according to one embodiment of this disclosure.

FIG. 3 is an enlarged view illustrating an inner configuration located near the duct 30. FIG. 4 is a perspective view illustrating the duct 30.

The duct 30 is composed of a first duct part 31, a second duct part 32, a third duct part 33, a fourth duct part 34, and a fifth duct part 35. The first duct part 31 is formed with a connection port 25 connected to the louver 72, and extends from the louver 72 to an arrangement region A where the fixing section 10 is arranged. The second duct part 32 continues to the first duct part 31, and extends along the arrangement region A. In the second duct part 32, heat exchange is performed between the air flowing in from the outside of the apparatus and the air heated by the fixing section 10. As a result, the air heated by the fixing section 10 is cooled. The first duct part 31 is connected to the louver (air inflow hole) 72 provided on the front surface side of the image forming apparatus 1 via the connection port 25. As described above, for the first duct part 31, suction is performed from the front surface side of the image forming apparatus 1. Therefore, regardless of an installation location of the image forming apparatus 1, it is possible to reliably and efficiently cause air flow into the first duct part 31, which permits more reliable cooling of the air heated by the fixing section 10.

The fifth duct part 35 continues to the second duct part 32, and is arranged in a region B, other than the arrangement region A, located between the housing 41 and the main body frame 42. The air whose temperature has increased through the heat exchange with the air heated by the fixing section 10 at the second duct part 32 circulates through the fifth duct part 35. The fifth duct part 35 is a portion provided for cooling this air whose temperature has increased. Thus, the region B where the fifth duct part 35 is arranged is preferably a region whose temperature does not increase much upon the images formation operation performed in the image forming apparatus 1. Upon the image formation operation, a temperature increase occurs near positions where configurations, such as the developing device, involved in image formation and configurations, such as a conveyance roller which conveys the recording paper, involved in conveyance are arranged. The fifth duct part 35 is arranged in a region where the aforementioned configurations involved in the image formation and the conveyance are not arranged, for example, a region near the paper feed cassette which stores the recording paper.

A region between the housing 41 and the main body frame 42 where the fifth duct part 35 is arranged is in contact with the air outside of the apparatus with the housing 41 in between. Thus, heat of the air circulating in the fifth duct part 35 is discharged towards the air outside of the apparatus via the housing 41. The main body frame 42 made of metal has high heat conductivity. Thus, the heat of the air circulating in the fifth duct part 35 is transmitted to the main body frame 42 made of metal. Note that the fifth duct part 35 may be installed in a manner such as to make contact with the main body frame 42. In this case, the heat of the air circulating in the fifth duct part 35 is more transmitted to the main body frame 42 made of metal, making it possible to efficiently discharge the aforementioned heat of the air to the air outside of the apparatus via the main body frame 42.

The fifth duct part 35 is curved in a meandering manner in the region B between the housing 41 and the main body frame 42 described above. The meandering of the fifth duct part 35 increases a contact area between an outer wall of the fifth duct part 35 and the air in the region B. Thus, heat exchange between the heat of the air circulating in the fifth duct part 35 and the air inside of the region B is efficiently performed.

The fourth duct part 34 continues to the fifth duct part 35, and extends along the arrangement region A at a position different from a position along which the second duct part 32 extends. In the fourth duct part 34, heat exchange between the air cooled at the fifth duct part 35 and the air heated by the fixing section 10 is performed. As a result, the air heated by the fixing section 10 is cooled.

As illustrated in FIG. 4, the second duct part 32 and the fourth duct part 34 are installed in the arrangement region A in parallel to each other in an orthogonal direction orthogonal to an extended direction. In the fifth duct part 35, a dimension (illustrated as "W1" in FIG. 4) of a portion 35*a* curved in a meandering manner in the aforementioned orthogonal direction is larger than an installation dimension (illustrated as "W2" in FIG. 4) of the second duct part 32 and the fourth duct part 34 in the orthogonal direction. Consequently, while the aforementioned heat exchange at the fifth duct part 35 is efficiently performed, the second duct part 32 and the fourth duct part 34 can be installed compactly.

The third duct part 33 continues to the fourth duct part 34, and extends from the louver 71 to the arrangement region A where the fixing section 10 is arranged. The fan 20 provided at the end part of the third duct part 33 located on the side close to the louver 71 causes the air heated by the fixing section 10 at the fourth duct part 34 to be discharged to the outside of the apparatus through the third duct part 33.

Moreover, the third duct part 33 is connected to a side surface part 20*a* of the fan 20, as illustrated in FIG. 4. Consequently, saving of an installation space for the third duct part 33 and eventually for the duct 30 can be achieved, and also the air discharged from the third duct part 33 to the side surface part 20*a* by the aforementioned air flow caused by the fan 20 can efficiently be discharged to the outside of the apparatus, thus permitting an improvement in efficiency in cooling the air heated by the fixing section 10 at the fourth duct part 34.

Due to increased awareness of environment problems in recent years, there have been demands for reducing an amount of ultrafine particles (UFPs) discharged to the outside of the image forming apparatus. The UFPs are generated by heating a silicon-based material used for, for example, the heat roller of the fixing section. Therefore, in a case where the air heated by the fixing section is discharged as is the case with the aforementioned typical image forming apparatuses, the amount of UFP discharged to the outside of the image forming apparatus increases.

On the contrary, in this embodiment, the air heated by the fixing section 10 can be cooled by the duct 30 as described above. The cooling is performed at the two sections including the second duct part 32 through which the air outside of the apparatus circulates and the fourth duct part 34 through which the air cooled at the fifth duct part 35 circulates, thus permitting efficient cooling of the air heated by the fixing section 10. Consequently, a temperature difference from members such as the recording paper guide 50 provided above the fixing section 10 can be reduced, permitting prevention of dew condensation in which waterdrops adheres to these members.

Moreover, the cooling of the air heated by the fixing section 10 is performed without discharging this air to the outside of the apparatus, and thus the UFPs generated by heating the silicon-based material used for, for example, the heat roller of the fixing section 10 are not discharged to the outside of the apparatus.

Moreover, the third duct part 33 has, at the same height position as a heightwise position where the connection port 25 of the first duct part 31 is installed, a part forming a horizontal duct part which horizontally extends. An end part of the horizontal duct portion and the louver 71 are connected together.

With the aforementioned configuration, the louver 71 and the louver 72 can be located at the same heightwise positions. The louver 71 and the louver 72 are formed on an outer surface of the housing 41, which therefore has great influence on design of the image forming apparatus 1. In a case where the louver 71 and the louver 72 are provided at different heightwise positions, impression with a sense of complication is given to the user without a sense of unity. In this point, the louver 71 and the louver 72 are located at the same heightwise positions in the image forming apparatus 1 described above, which therefore can provide the user with impression with a sense of unity.

Here, in a case where positions of the louver 71 and the louver 72 are close to each other as a result of locating the louver 71 and the louver 72 at the same heightwise positions, there arises a risk that the heated air exhausted from the louver 71 is suctioned by the louver 72. In this point, in the image forming apparatus 1 described above, the third duct part 33 has, at the same height position as the heightwise position where the connection port 25 of the first duct part 31 is installed, the part forming the horizontal duct part which horizontally extends. This consequently can locate the louver 71 and the louver 72 at the same heightwise positions, and also can provide the louver 71 and the louver 72 at the positions horizontally separated from each other.

Note that the invention is not limited to the configuration of the embodiment described above, and thus various modifications can be made to the invention.

Modified Example 1

Figure 5:
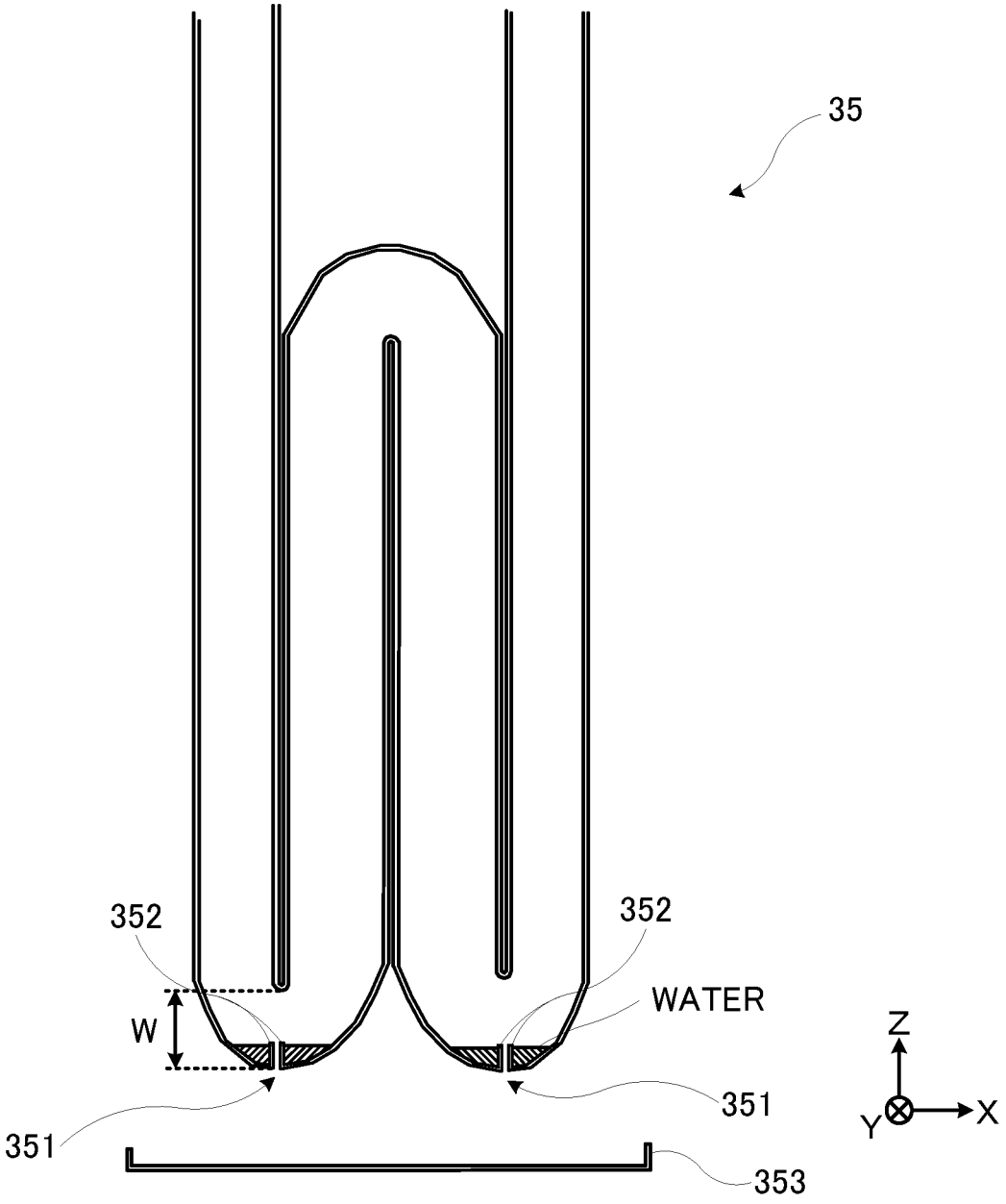
FIG. 5 is a view illustrating a cross section of a duct of an image forming apparatus according to a modified example.

FIG. 5 is a view illustrating a cross section of a fifth duct part 35 of an image forming apparatus according to Modified Example 1. As illustrated in this figure, in the image forming apparatus according to Modified Example 1, formed at portions located at lowest vertical (Z direction) positions of a circumferential wall forming the fifth duct part 35 are through holes 351 which penetrate through the aforementioned circumferential wall. Moreover, a tray 353 of a substantially flat plate-like shape is installed vertically below the through holes 351.

In the fifth duct part 35, heat exchange is performed between the air inside of the fifth duct part 35 and the air inside of a region B between a housing 41 and a main body frame 42, whereby the air inside of the fifth duct part 35 is cooled. Thus, waterdrops generated through the cooling of the aforementioned air adhere to an inner circumferential surface of the circumferential wall of the fifth duct part 35. The waterdrops are accumulated at the portions located at the vertically lowest positions in the fifth duct part 35 due to the gravity. With the image forming apparatus according to Modified Example 1, the water accumulated in the fifth duct part 35 can be discharged as waterdrops to an outside of the fifth duct part 35 through the through holes 351. The discharged waterdrops are accumulated on the tray 353 provided below the through holes 351, and then evaporate.

Moreover, in the image forming apparatus according to Modified Example 1, formed in the fifth duct part 35 are wall parts 352 of an annular columnar shape which extends vertically upward from the inner surface of the circumferential wall of the fifth duct part 35 to surround the through holes 351. With the presence of the wall parts 352, only a fixed amount of the waterdrops adhering to the inner surface of the circumferential wall of the fifth duct part 35 is accumulated at the portions located at the vertically lowest positions in the fifth duct part 35. The water accumulated in the fifth duct part 35 makes contact with the air passing through the fifth duct part 35, playing a role of cooling the aforementioned air. Moreover, in a case where the fixed amount of water or more is accumulated and the accumulated water exceeds a height of the wall parts 352, the water is discharged as waterdrops from the through holes 351.

Further, in the image forming apparatus according to Modified Example 1, a duct width W of the portion of the fifth duct part 35 located at the vertically lowest position may be made wider than a duct width of any other portion. The water accumulation in the fifth duct part 35 as a result of providing the wall parts 352 as described above accordingly narrows a width across which the air can circulate in the fifth duct part 35. Thus, making the duct width W of the fifth duct part 35 wider than the duct width of any other portion permits efficient circulation of the air in the fifth duct part 35.

Modified Example 2

Figure 6:
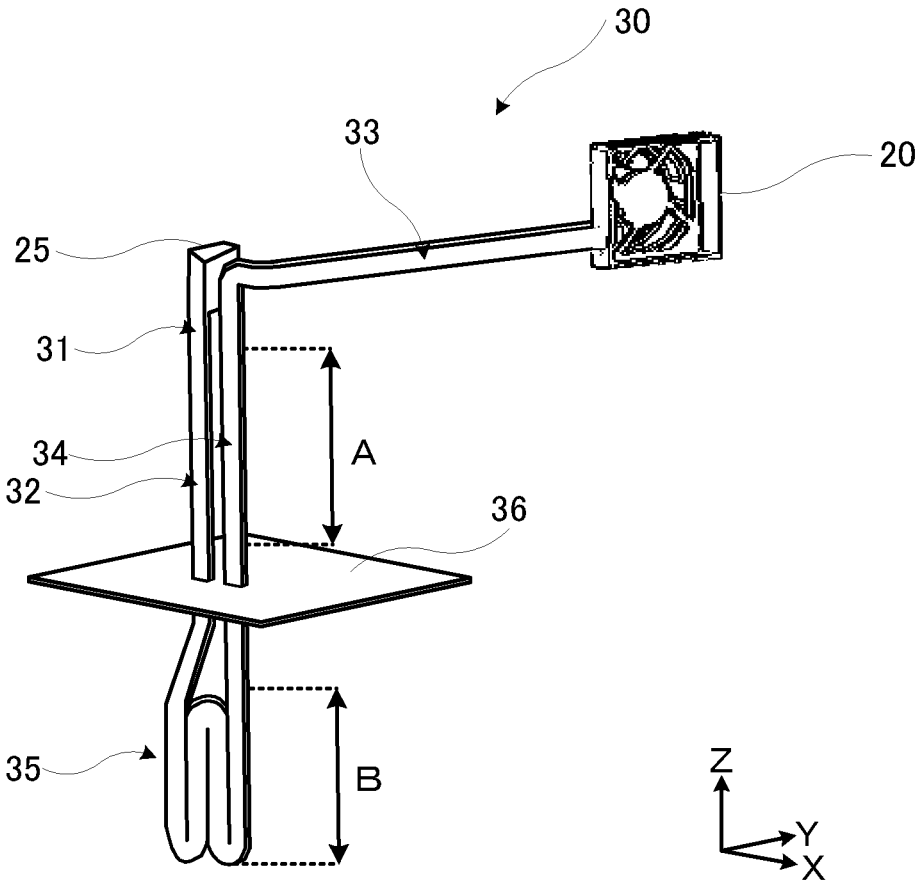
FIG. 6 is a perspective view illustrating a duct of an image forming apparatus according to a modified example.

FIG. 6 is a perspective view illustrating a duct of an image forming apparatus according to Modified Example 2. As illustrated in the figure, installed in the image forming apparatus according to Modified Example 2 is a partitioning member 36 which partitions a region where a second duct part 32 and a fourth duct part 34 are arranged and a region where a fifth duct part 35 is arranged. The partitioning member 36 is a member of a flat plate-like shape formed of a material with low heat conductivity. Providing the partitioning member 36 at the aforementioned position prevents heat transmission from an arrangement region A where a fixing section 10 is arranged to a region B where the fifth duct part 35 is arranged.

Moreover, the partitioning member 36 is in contact with a circumferential wall of a duct 30 between the region where the second duct part 32 and the fourth duct part 34 are arranged and the region where the fifth duct part 35 is arranged. Thus, heat of a circumferential wall of the second duct part 32 and a circumferential wall of the fourth duct part 34, which have been heated to a high temperature, is transmitted to the partitioning member 36, making it difficult to transmit the heat to a circumferential wall of the fifth duct part 35.

Modified Example 3

The embodiment has been described above, referring to a case where the fifth duct part 35 is curved (folded) at three portions to be formed in a meandering manner, but the fifth duct part 35 may be curved at three or more portions to be formed in a meandering manner. An increase in several curved portions results in an increase in a contact area of the fifth duct part 35 in contact with the air in the region B between housing 41 and the main body frame 42, thus permitting further cooling of the air inside of the fifth duct part 35.

Another Modified Example

An air-cooling fan which generates an air flow directed towards the fifth duct part 35 may be installed at a position near the fifth duct part 35. Providing the air-cooling fan permits more efficient cooling of the air in the fifth duct part 35.

Moreover, the embodiment has been described above, referring to the image forming apparatus which forms an image on recording paper through an electrophotographic method, but the invention is also applicable to other image forming apparatuses such as an inkjet printer.

Various modifications and alterations of this disclosure will be apparent to those skilled in the art without departing from the scope and spirit of this disclosure, and it should be understood that this disclosure is not limited to the illustrative embodiments set forth herein.

What is claimed is:

1. An image forming apparatus comprising:

an image formation section forming an image on recording paper;

a fixing section fixing the image onto the recording paper by heating the recording paper on which the image is formed;

a housing being an outline of the image forming apparatus; and a main body frame supporting the image formation section and the fixing section, wherein the housing is provided with: an air inflow hole; an air outflow hole, a duct connecting together the air inflow hole and the air outflow hole; and a fan circulating air in the duct, and the duct has: (i) a first duct part extending from the air inflow hole to an arrangement region where the fixing section is arranged; (ii) a second duct part extending from the first duct part and extending along the arrangement region; (iii) a third duct part extending from the air outflow hole to the arrangement region; (iv) a fourth duct part continuing to the third duct part and extending along the arrangement region at a position different from a position along which the second duct part extends; and (v) a fifth duct part being provided between the second duct part and the fourth duct part and being curved in a meandering manner in a region, other than the arrangement region, located between the housing and the main body frame.

2. The image forming apparatus according to claim 1, wherein a portion of a circumferential wall forming the fifth duct part located at a vertically lowest position is formed with a through hole penetrating through the circumferential wall, and the image forming apparatus further comprising a tray being provided vertically below the through hole and receiving a waterdrop leaked out from the through hole.

3. The image forming apparatus according to claim 2, wherein the fifth duct part is formed with a wall part of an annular columnar shape extending vertically upward from an inner surface of the circumferential wall to surround the through hole.

4. The image forming apparatus according to claim 3, wherein a duct width of the portion of the fifth duct part located at the vertically lowest position is wider than a duct width of any other portion of the fifth duct part.

5. The image forming apparatus according to claim 1, further comprising a partitioning member partitioning a region where the second duct part and the fourth duct part are arranged and a region where the fifth duct part is arranged.

6. The image forming apparatus according to claim 1, wherein the fifth duct part is curved at at least three or more portions.

7. The image forming apparatus according to claim 1, wherein the third duct part has, at a same heightwise position as a heightwise position where an end part of the first duct part connected to the air inflow hole is provided, a horizontal duct portion extending orthogonally to a height direction, and an end part of the horizontal duct portion and the air outflow hole are connected together.

8. The image forming apparatus according to claim 1, wherein the fifth duct part is in contact with the main body frame made of metal.

9. The image forming apparatus according to claim 1, wherein the second duct part and the fourth duct part are installed in the arrangement region in parallel to each other in an orthogonal direction orthogonal to an vertical direction, and a value of a dimension of the portion of the fifth duct part curved in a meandering manner in the orthogonal direction is greater than a value of an dimension of the second duct part and the fourth duct part in the orthogonal direction.

10. The image forming apparatus according to claim 1, wherein the third duct part is connected to a side surface part of the fan.

11. The image forming apparatus according to claim 1, wherein the air inflow hole connected with the first duct part is provided on a front surface side of the image forming apparatus in the housing.

* * * * *